US005465958A

United States Patent [19]

Brun

[11] Patent Number: 5,465,958

[45] Date of Patent: Nov. 14, 1995

[54] OFF-ICE HOCKEY SHOOTING PRACTICE DEVICE

[76] Inventor: Paul E. Brun, 253 Jean-Darois, Dieppe, New Brunswick, Canada, E1A 6H2

[21] Appl. No.: 374,881

[22] Filed: Jan. 19, 1995

[51] Int. Cl.[6] ..... A63B 69/00

[52] U.S. Cl. ..... 273/57.2

[58] Field of Search ..... 273/57.2, 26 EA, 273/200 A

[56] References Cited

U.S. PATENT DOCUMENTS

| | | | |
|---|---|---|---|
| 2,680,022 | 6/1954 | Walden | 273/26 EA |
| 3,955,815 | 5/1976 | Deschesnes | 273/57.2 |
| 4,070,017 | 1/1978 | Lombardi | 273/57.2 |
| 4,607,842 | 8/1986 | Daoust | 273/57.2 |
| 5,120,055 | 11/1992 | McCarthy et al. | 273/57.2 |
| 5,238,243 | 8/1993 | Grispi | 273/57.2 |

FOREIGN PATENT DOCUMENTS

| | | |
|---|---|---|
| 605665 | 9/1960 | Canada . |
| 958436 | 11/1974 | Canada . |
| 1085887 | 9/1980 | Canada . |
| 1129451 | 8/1982 | Canada . |
| 1204460 | 5/1986 | Canada . |
| 1225675 | 8/1987 | Canada . |

*Primary Examiner*—William H. Grieb
*Attorney, Agent, or Firm*—Nixon & Vanderhye

[57] ABSTRACT

An off-ice hockey shooting practice device includes a linear guideline means with a tethered puck slidable therealong. The linear guide runs generally above the ground between a shooting station and a target. The target surface bears the outline of a hockey goal, a goalie figure, and discrete target positions. The tether extends between the puck and the linear guide along which the tether can slide. A shot puck may rebound from the target, from a resilient target surface or by means of a resilient tether. The resilient target surface results from an elastic connection between the target surface and the target frame. The length of the tether connected to the linear guide is generally sufficient to prevent the puck from missing the target and causing damage.

19 Claims, 4 Drawing Sheets

OFF-ICE HOCKEY SHOOTING PRACTICE DEVICE

The present invention pertains to a device for aiding a hockey player to practice and improve hockey shooting skills. The device is particularly adapted to use by a single player in a off-ice location, either indoors or outdoors.

The hockey shooting practice device of the present invention includes a goal target, a shooting position and guideline means, for a tethered puck, extending between the target and shooting position. In a preferred form, the target has a resilient surface bearing the outline of a hockey goal, a goalie figure, and discrete target positions between the goalie and goal outlines. Of particular importance in the present invention is the guideline means, which may be in an inclined elevated linear guide or other similar linear device extending between the shooting position and the target. The guideline means, in conjunction with a puck or other puck simulation devices tethered to it, prevents a hockey puck which is being shot at the target, from being misdirected beyond the target surface, and consequently prevents the hockey puck from causing damage to objects or persons beyond the target area. Furthermore, where the target surface or the tether is resilient, a shot puck is caused to rebound generally towards the shooter with a consequential convenience of avoiding the requirement of a single player to chase after the puck.

BACKGROUND OF THE INVENTION

Hockey is a team sports game played in many countries of the world under many conditions, rules and names. Ice hockey is played by teams from many nations, in national and international leagues, and in amateur and professional competition. As it is self-evident that the objective in a game of ice hockey is to score goals against the competing team, consequently it is desirable that hockey players become skilled in accurate shooting of a puck into a defended goal.

Although in team practice, players can hone their shooting skills, this can normally only be done under the constraints of team practice on an ice rink, with the consequent costs of such an enterprise. Less formal practice can be undertaken off-ice, but again it requires a team of players.

In hockey, good shooting skills are normally related to the number of hours a player spends practising hockey shots on the ice or off the ice. Because the majority of hockey players spend a relatively small number of hours on the ice counting practises and games and because most time spent on the ice is for skating and for play making with very little time actually spent on shooting, it is known in hockey that most players need to practice hockey shooting off the ice with a real puck to develop good shooting skills. The practising of off-ice hockey shooting with a real puck, using existing methods, the hockey net or the hockey net with a backstop, is however not very practical and safe for most homes resulting in very few hockey players practising hockey shots off the ice. Also the time lost in retrieval of the hockey puck is a deterrent to the practice of off-ice hockey shooting.

It is common in street hockey to use a soft rubber puck, a rolling puck, a street hockey ball, or similar devices to simulate hockey shooting on the net and/or target. It is also known that for better simulation of on ice hockey shooting a real puck must be used. However, if a real puck is used, there is a major risk of puck damage to the surrounding environment.

DESCRIPTION OF PRIOR ART

In the event that a single player wishes to practice shooting skills, many devices are available to assist, but all have greater or lesser problems and inconveniences associated with them. For example (in its simplest form), a single player may simply shoot a puck towards an open net. This presents a very large, unchallenging target, and requires retrieval of the puck by the player after each shot. Other devices may be substituted for and used to simulate a traditional rubber puck, such as a plastic puck shaped piece or even a ball. Nonetheless, all of these devices must be retrieved by a sole player.

It is further known to assist hockey training by means of target areas simulating a defended goal, such as in U.S. Pat. No. 5,238,243 where a simulated goalie and target areas are illustrated. Other training devices are known which are used to improve the strength of a shot, but not the directed accuracy, such as disclosed in U.S. Pat. No. 3,955,815. Retrieval means for game pieces such as balls are known which utilize a resilient backstop or target. For example, Canadian Patent 605,665 discloses a baseball backstop comprising a net elastically mounted in a frame to cause a ball to rebound towards the ground and the pitcher. Similarly, Canadian Patent 1,225,675 illustrates a net held under tension in a frame whereby a resilient ball rebounds from the net towards the player in an emulation of the game of tennis. Alternatively, tethers have been applied to puck devices in order to assist with retrieval, as in the puck tethered to a hockey stick with a retrieval reel disclosed in Canadian Patent 1,085,887.

All of the foregoing devices suffer from deficiency as a practice device for a solo hockey player. In particular, none of the devices prevents a shot puck or ball from causing damage when it misses the net target. Consequently, all of the preceding devices require retrieval effort by the shooter. None provide for consistent return of a shot ball or puck, especially an inaccurately shot ball or puck, to the shooter.

SUMMARY OF THE INVENTION

The present invention overcomes the foregoing problems and provides a particularly apt device for a solo shooter. In its simplest structure, the present invention embodies a tethered puck constrained by a guideline means, such as an inclined track, wire cord or other linear guide, which extends between a shooting position and a target. Such guideline means may be straight if formed as a rigid track, or may have a slight catenary if formed as a taut line or cable. The guideline means includes a tether connecting between the puck and a slider device on the linear guide. Thus, a puck or other shot implement is retained in physical connection to the guideline means. By selecting an appropriate length of tether, it may be ensured that a shot puck will be prevented from missing the target. By providing a resilient target surface, it may be ensured that the shot puck will rebound towards the shooter, again guided by the guideline means, thereby assisting the return of the puck to the shooter. Similarly, in a further embodiment, rebound of the shot puck can be provided by use of a resilient tether, such as elasticized cord.

Although reference is made throughout this disclosure to a "puck", it will be readily understood that such puck is not restricted to the hard rubber disc of a regulation hockey puck, but could utilize any device having the same general shape and weight as a hockey puck. For example, a plastic disc structure, properly weighted, and having friction characteristics adapted to permits it ready sliding on shooting station 11, may be particularly desirable. Other shooting pieces, such as balls or heavy weighted practice pucks, may also be used.

The present device having the foregoing elements overcomes the problem of retrieval of pucks or similar devices which miss the target, and consequently avoids damage caused by pucks which miss the target. Furthermore, the efficiency of practice time is dramatically increased as a shot puck tends to rebound to the shooting position of the player, thereby reducing or eliminating retrieval time. Lastly, the device permits practice in off-ice conditions, and may be used outdoors, or indoors. The latter environment then permits practice during inclement weather or under artificial light.

BRIEF DESCRIPTION OF THE DRAWINGS

Further advantages and uses of the foregoing invention may be ascertained from the following description in association with the attached drawings wherein, FIGURES 1(*a*) and 1(*b*) are side elevation and top plan schematic views respectively of a first embodiment of the invention.

DESCRIPTION OF THE PREFERRED EMBODIMENT

Figure 1A:
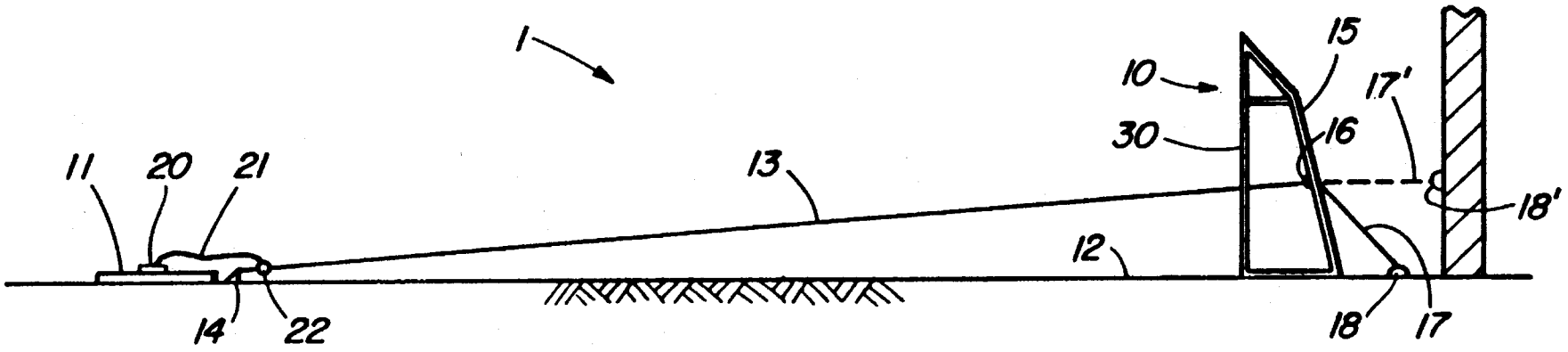
Figure 1B:
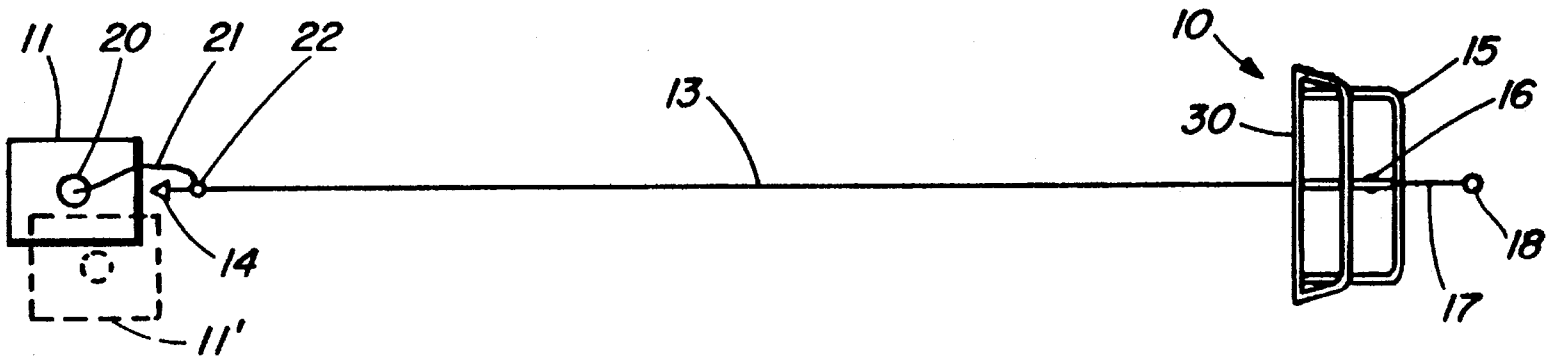

With reference now to the drawings, and in particular to FIGS. 1(*a*) and (*b*), the device of the present invention can be seen in its simplest form. The shooting practice device is shown generally at 1, and comprises a target structure 10, and a shooting station 11 both of which rest on a playing floor or ground surface 12. The target 10, station 11 are separated from one another by a distance which is selected by the shooter. A linear guide 13 extends generally between the shooting station 11 and the target 10 and slopes generally upward from ground level at the shooting position 11, to a generally mid-point on the target 10. Linear guide 13 may be of any suitable linear element, such as a wire, preferably coated with a nylon, vinyl or similar material, or such as monofilament line.

Linear guide 13 is attached to the playing surface 12 at the general location of the shooting position by an anchor 14 in the general vicinity of shooting station 11. The other end of linear guide 13 is attached to target frame 15 at anchor 16. Anchor line 17 extends between anchor 16 and anchor 18 to prevent target frame 15 from toppling over in consequence of tension in the linear guide 13.

Where target 10 is positioned against a generally vertical structure such as a wall of a building or room, anchor line 17 may be extended horizontally to a point of attachment as shown in phantom by line 17' and anchor 18'.

The exact structure and operation of ground anchor 14 will, of course, depend upon the material substance constituting surface 12. For example, in earth or asphalt, a spike or heavy nail may be used to anchor the linear guide 13, whereas in concrete, it may be necessary to use an appropriate screw and anchor in a drilled hole. Ultimately, the structure used for anchor 14 will depend on ground conditions, and must be able to withstand the tension generated in linear guide 13. Alternatively, in an enclosed space such as a room, anchor 14 may be installed in a rear wall of the room in a manner similar to anchor 18' (see FIG. 6(*a*) for example).

It should be noted that although the embodiment illustrated in FIGS. 1(*a*) and (*b*) discloses a linear guide 13 such as a wire or monofilament line, alternative linear guide means may be employed, such as a tubular track or an elastic member such as a shock cord. In the event that a tubular track is used, the method of attachment at anchors 14 and 16 may be altered, and anchor line 17 may be unnecessary.

A hockey puck 20 is connected to linear guide 13 by a tether 21 such as a nylon coated flexible stainless steel wire, or even high tensile plastic monofilament line. The tether 21 is attached to a slide ring 22 or other sliding mechanism in order to permit the ring 22, tether 21 and attached puck 20 to traverse longitudinally along linear guide 13. It is desirable to use a swivel (not shown), at the connection between the puck 20 and tether 21, or between the tether and the slide ring 22.

A hockey player or shooter (not shown), who wishes to use the device, would use a hockey stick (not shown) to propel or shoot puck 20 towards the target 10. While the position of the shooter (i.e. the shooting position) may merely be an area outlined on the ground or playing surface adjacent the anchor 14, it is desirable to use a separate shooting surface 11 to demark the preferred shooting position and to provide a proper shooting surface. Shooting station 11 comprises a mat or sheet of suitable smooth material to emulate the low coefficient of friction existing between an actual hockey puck and an ice surface. The mat is laid directly on the playing surface 12. Factors influencing the selection of material for the shooting surface 11 will include material durability and resistance to the impact forces of hockey sticks. In addition, the surface should be a relatively thin sheet material so as not to raise the shooting surface noticeably above the ground playing surface. Examples of satisfactory material are polystyrene, polyethylene and plexiglass. Shooting station 11 may also include a backing of a frictional material in order to prevent or reduce relative movement between shooting station 11 and floor 12.

Figure 6A:
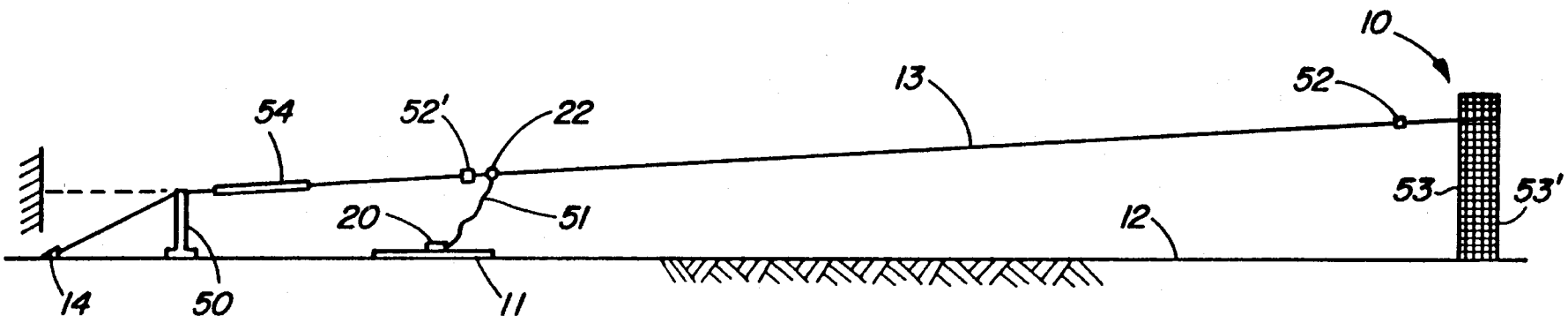
FIGS. 6(*a*) and 6(*b*) are side elevation and top plan schematic views incorporating other embodiments of the invention.
Figure 6B:
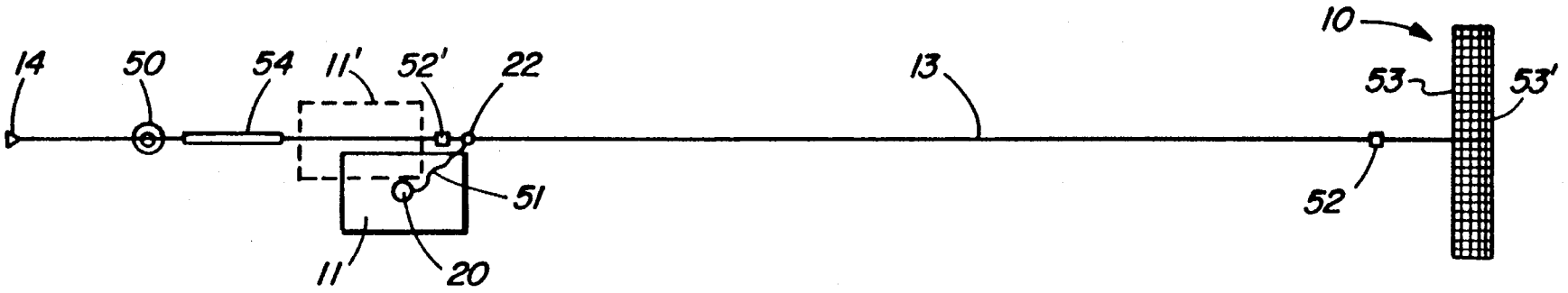

Shooting station 11 may be placed directly behind anchor 14, or laterally displaced on either side of the anchor (see FIG. 1(*b*), as in phantom at 11', or may be placed in front of the anchor as illustrated in FIG. 6B at 11'). This will permit a player, whether left-handed or right-handed, to shoot a forehand or backhand shot from alternate sides of the approach to the goal net of target 10. In use, a shooter or player will stand beside or on shooting station 11 and project or "shoot" puck 20 with a hockey stick towards the target 10.

If puck 20 has been shot generally accurately towards the target 10, the puck will travel towards the target relatively uninhibited by the light weight of tether 21 and its slide ring 22 as they travel along linear guide 13. Properly shot, puck 20 would strike target 10 and, in consequence of the resilience of the target as described hereafter, rebound towards shooting station 11.

In the event that a puck is inaccurately shot towards the target 10, the length of tether 21 is selected to be no more than one half of the width of target 10. Consequently, an inaccurately directed puck is restrained from extending laterally beyond the edges of the target surface 30.

Figure 4:
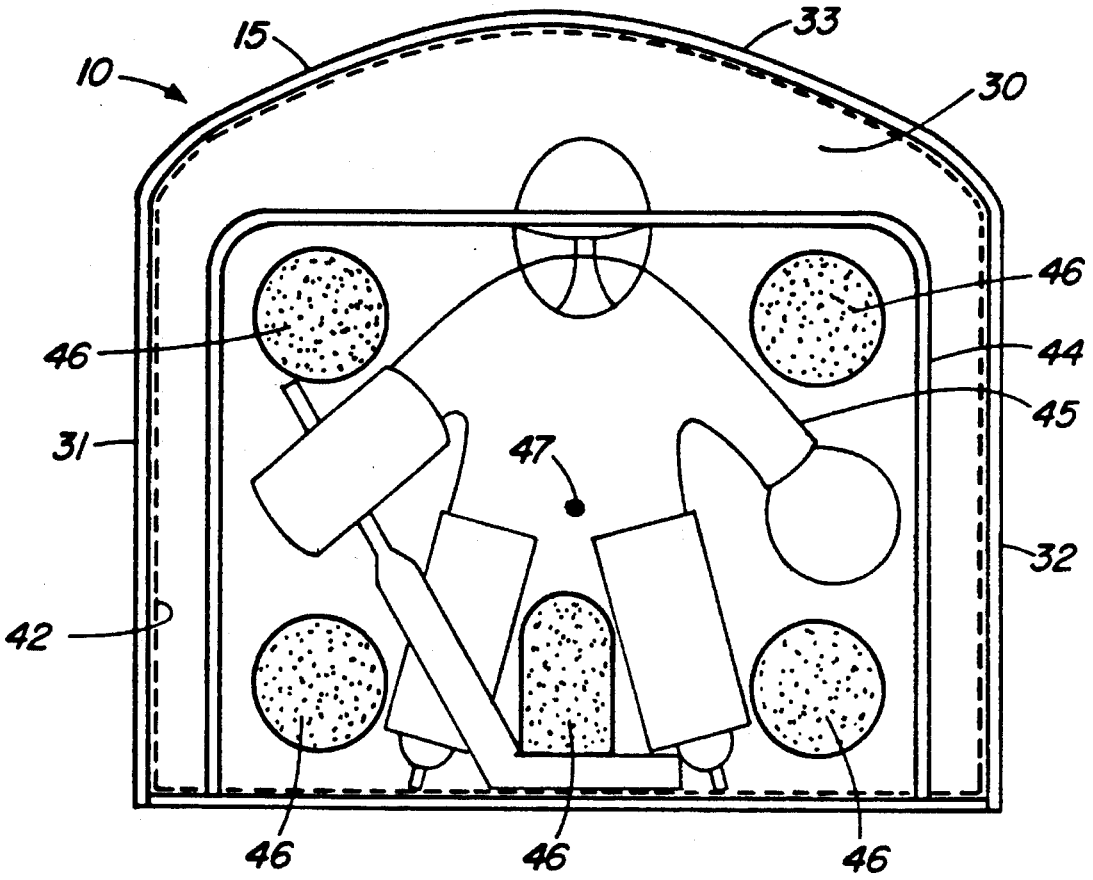
FIG. 4 is a front plan view of a target.
Figure 5:
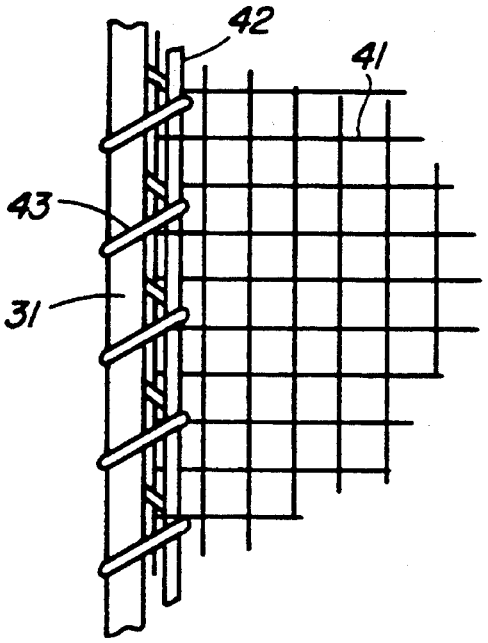
FIG. 5 is a partial front plan of the target illustrating the resilient connection.

In particular, referring to FIG. 4, the tether 21 should not exceed the horizontal distance between the bilateral centre point 47 of the target surface and either vertical side post 31 or 32 of the target 10. That limited distance permits a puck to be shot at any area within the simulated goal outline 44, but will not allow the puck to exceed the outer perimeter of the target frame defined by posts 31 and 32, and upper bar 33.

Figure 2:
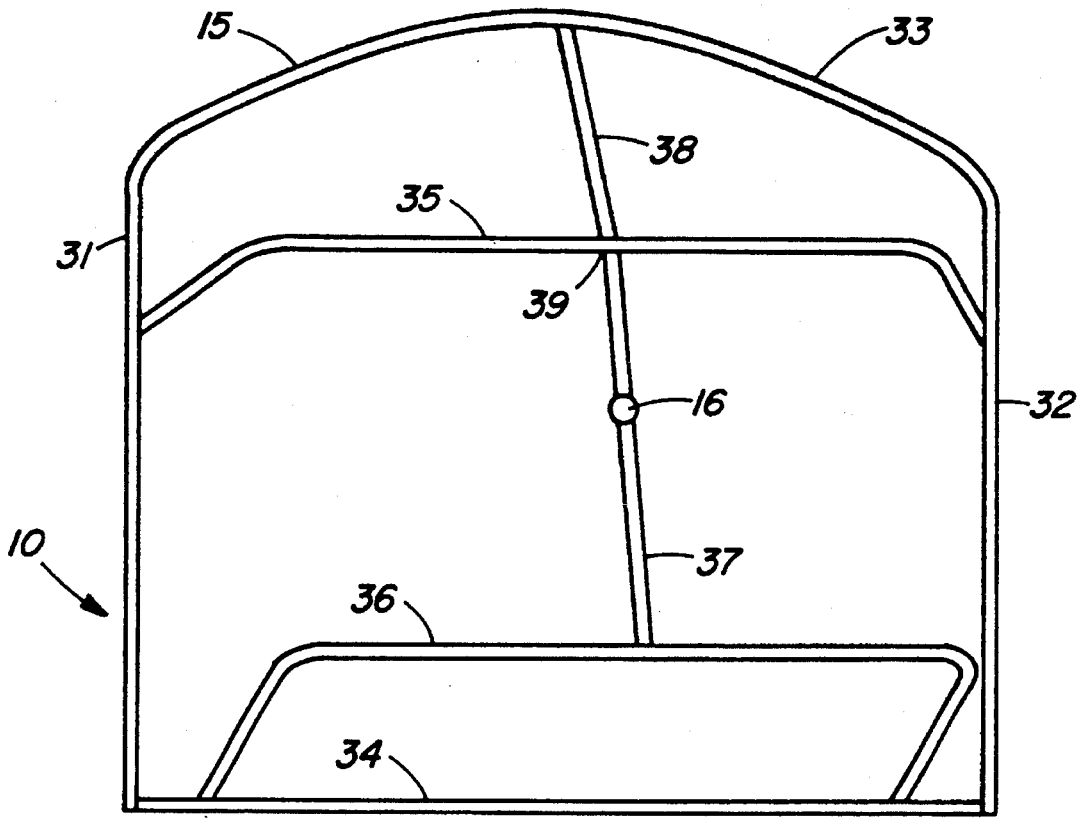
FIG. 2 is a perspective view of the target frame.
Figure 3A:
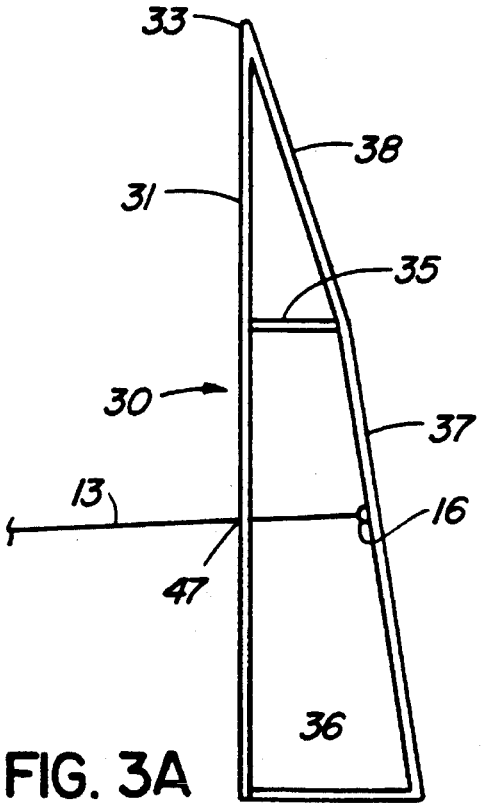
FIGS. 3(*a*) and 3(*b*) are side profiles of alternative frame structures.
Figure 3B:
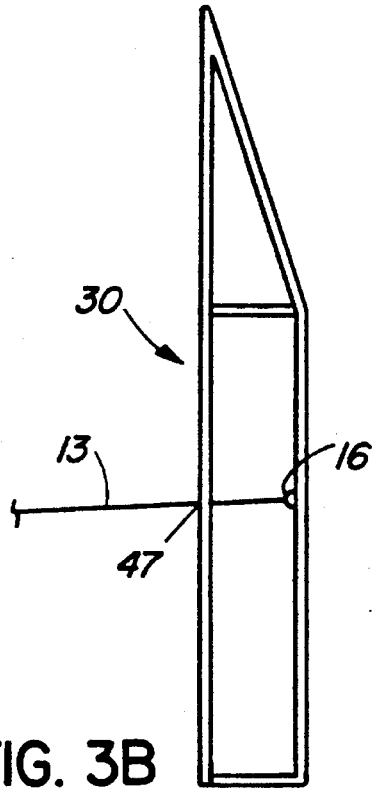

Referring now to FIGS. 2 and 3(*a*), target 10 comprises a structural frame 15 which supports a generally planar target surface 30. Surface 30 may be of suitable netting or mesh configuration such as simulates a hockey net, or may be of plasticized canvas or similar durable sheet material. In outdoor usage where it will be subject to winds, a target with an open mesh surface is preferable. Frame 15 includes vertical side posts 31 and 32, arcuate upper bar 33 and horizontal lower bar 34 which are interconnected to form a perimeter frame supporting the target surface 30. A generally U-shaped horizontal shoulder rail 35 extends between posts 31 and 32 at shoulder height. A generally U-shaped foot rail 36 extends from lower bar 34. A back brace 37 interconnects shoulder rail 35 and foot rail 36 generally at their mid-points. A similar back brace 38 interconnects upper bar 33 and shoulder rail 35. Lower bar 34 and foot rail 36 define a horizontal component of frame 15 which rests on floor surface 12 and supports the remainder of the frame.

Although FIGS. 2 and 3 show a rigid frame, it may readily understood that pivotal connections will permit the frame to fold and enable flat storage of the target device. For example, pivotal connections of posts 31 and 32 with shoulder rail 35 as well as pivotal connections between foot rail 36 and lower bar 34, together with pivotal connections between back brace 37 and foot rail 36 as well as between back brace 38 and upper bar 33, together with detachable connections 39 between back braces 37 and 38 with shoulder rail 35, will permit folding of the shoulder rail 35 and foot rail 36 into the plane of the perimeter frame 31, 32, 33 and 34.

As well, where the frame is positioned close to a wall, frame 15 may be designed to have a reduced depth, such as providing for a vertical back brace as may be seen in FIG. 3(*b*). The exact size and shape of the frame is not essential to the invention so long as the frame serves to adequately support the target surface.

It will also be understood that the frame members may be made from any material suitable to resist impact, maintain structural strength and resist moisture, such as galvanized or enamelled steel, aluminum tubing or glass-fibre rods.

As may be seen from FIG. 4, target 10 includes a target surface 30 mounted on target frame 15. Target surface 30 comprises a netting or mesh material 41 having a spacing comparable to that of a standard hockey net. Around the perimeter of netting 41 is placed, by stitching or interweaving, a shock cord 42. Shock cord 42 is integral with netting 41, and is held adjacent perimeter members 31, 32, 33 and 34 by lacing 43. Consequently, deflection of netting 41 under the impact of a puck or similar device will cause shock cord 42 to stretch and return to its confined position, pulling netting 41 back into its planar configuration and propelling the puck back towards the shooter. The netting acts in a manner similar to a trampoline, causing rebound of objects bounced against it. However, as a result of the close conformity of shock cord 42 to perimeter frame members 31, 32, 33 and 34, there is no space left between the edge of netting 41 and perimeters 31, 32, 33 and 34 of frame 15 to permit passage of an errant puck.

As may also be seen from FIG. 4, a tape, ribbon or other material may be positioned within the mesh of netting 41 to simulate the outline of a hockey net 44. Such outline may represent a regular goal mouth size, or may be smaller for juvenile players. Similarly, there may be applied a silhouette or other representation of goalie FIG. 45. Such representation may be of any cloth-like or plastic material stitched or otherwise held to the mesh surface of netting 41.

Target areas 46 may also be positioned in strategic places between the goalie outline 45 and net outline 44. Target areas 46 represent opportune locations for potential goal scoring. Target areas 46 may be cloth or plastic materials affixed to the mesh netting 41 in a similar manner as goalie outline 45. Alternatively, target areas 46 may be of a more semi-rigid material such as plastic sheets of polyethylene, polystyrene, polyurethane or other similar durable moisture resistant substances. An advantage of utilizing such semi-rigid plastic material for target areas 46 results from the resonant effect when such a target area is struck by a puck. Consequently, a shooter who successfully directs puck 20 into contact with target areas 46 will be rewarded with a resonant impact sound quite different from the almost silent contact of the puck against netting 41 and net or goalie outlines 44 and 45.

Referring now to FIGS. 6(*a*) and 6(*b*), alternative embodiments of the hockey shooting practice device may be seen. In one embodiment, shooting station 11 is located offset between anchor 14 and target 10 (or in line as at 11'). In that embodiment, however, linear guide 13 is further elevated above ground level 12 by a prop or post 50. The increased elevation of linear guide 13 resulting from the imposition of post 50 permits increased ease of movement of puck 20 towards the target as tether 51 has a reduced tendency to drag on ground surface 12. Similarly, the downward slope assists in the rebound of puck 20 and its tether 51.

In a further embodiment of the invention seen in FIGS. 6(*a*) and 6(*b*), the resilient rebound target surface 30 may be eliminated, and a substitute form of rebound of puck 20 provided by the use of an elasticised tether 51. In this aspect of the invention puck stopper or arrester 52 is affixed on the linear guide 13 adjacent the face of target 10 but spaced from the non-resilient surface 53 by a distance slightly greater than the length of the tether 51, i.e. by a distance slightly greater than one half the width of the target area. In this embodiment, target 10 may be a standard hockey net of loose mesh, having a target surface 53'. Alternatively, target 10 may be a solid wall, such as concrete, where the target surface 53 is rigid. Thus, when puck 20 is shot towards the target, tether 51 and ring 22 traverse the linear guide 13 until ring 22 comes into contact with arrester 52. At that point, the forward momentum of puck 20 causes elastic tether 51 to stretch until the puck contacts the target surface. Upon contact, the elastic reaction of tether 51 (and possibly combined with the inherent elasticity of puck 20) causes the puck to rebound towards the shooter.

Depending upon the strength of shot, and the placement of arrester 52, considerable elastic rebound can be generated for puck 20. Thus, it is desirable that a further arrester 52' be positioned adjacent the shooting position to retard and stop the returning puck. As well, as the returning puck may have a tendency to strike linear guide 13, an impact absorbing device 54 may be placed on the linear guide. The impact absorber 54 may be a tubular sponge or foam rubber sleeve, or may be a loose fitting sleeve of material such as ABS tubing. Further, as an alternative to elastic tether 51, impact absorber 54 may include a resilient structure, such as a strong spring, to permit limited elastic elongation under the stress of impact loads generated in linear guide 13 when slider 22 contacts arrester 52 during a practice shot.

A person skilled in the art will appreciate that variations on the foregoing embodiments may be utilized. For example, the resilient net may be employed in conjunction with a resilient tether. Similarly, many different forms of slider 22 may be employed as may be different forms of arrester 52. Different target structures and frames, as well as anchors may be combined with the guided, tethered puck of this invention.

The foregoing device may be used in an open field, or on a lawn, may be used on an asphalt surface such as a road or a driveway, and may be used in enclosed environments such as a garage or basement room. Consequently, hockey shooting practice is removed from the constraints of an ice surface, and may be undertaken during periods of inclement weather under artificial lighting.

It will be understood that the foregoing description is merely by way of example, and shall not be construed as limiting. Further changes in the structure which would occur to a person skilled in the art are within the scope of the claims without departing from the spirit of the invention.

The embodiments of the invention in which an exclusive property or privilege is claimed are defined as follows:

1. An off-ice hockey practice shooting device for use by a player on a playing surface, the device comprising a shooting station on the playing surface, a target surface remote from the station, and a puck device connected to a generally linear guideline means extending between the station and the target, wherein the guideline means comprises a linear guide and a flexible tether slidably connecting the puck device to the guide.

2. The hockey device of claim 1, wherein the guide is held under tension by an anchor at each end.

3. The hockey device of claim 2, wherein one end of the guide is inclined from said shooting station and affixed to the target adjacent the mid-height of the target.

4. The hockey device of claim 1, wherein the tether has a length limited to prevent the puck from passing beyond the target surface.

5. The hockey device of claim 4, wherein the tether includes a swivel connection.

6. The hockey device of claim 4, wherein the tether is a flexible wire.

7. The hockey device of claim 6, wherein the tether is a shock cord and the guide includes arresting means to interrupt movement of the tether along the guide.

8. The hockey device of claim 1, wherein the station includes a shooting surface adapted to be placed on the playing surface and wherein the surface is of a smooth material permitting the emulation of the interaction between an ice surface and a hockey puck.

9. The hockey device of claim 1, wherein the target surface comprises a planar surface resiliently disposed closely adjacent a supporting frame.

10. The hockey device of claim 9, wherein the target surface has a perimeter edging of shock cord.

11. The hockey device of claim 10, wherein the target surface is held within the frame by fastening means extending between the frame and the perimeter edging.

12. The hockey device of claim 9, wherein the target surface has an outline of a hockey net and simulated goalie positioned within the hockey net.

13. The hockey device of claim 12, wherein the target surface has target areas positioned between the simulated hockey net and goalie outlined on its face.

14. The hockey device of claim 13, wherein the target areas are made of a resonant material attached to the target surface.

15. The hockey device of claim 10, wherein the target surface is a mesh or net material.

16. The hockey device of claim 10, wherein the frame is a self-standing rigid structure.

17. The hockey device of claim 10, wherein the frame is anchored against tipping toward the shooting surface.

18. An off-ice hockey practice shooting device for use by a player on a playing surface, the device comprising a shooting station of plastics material suitable to emulate an ice surface, a resilient target having a target surface and a perimeter thereto, said target being remote from said station, and a linear guide inclined upwardly from said station to said target, with a puck device slidably tethered to said guide, wherein said guide intersects said target surface adjacent its bi-lateral mid-point, said tether having a length generally equal to the maximum distance from said mid-point to said perimeter of said target.

19. The hockey device of claim 18, wherein the target includes a frame which resiliently supports said target surface having an edging of shock cord by means of connectors extending between said shock cord and said frame at discrete intervals.

* * * * *